US010322576B1

(12) United States Patent
Juarez et al.

(10) Patent No.: US 10,322,576 B1
(45) Date of Patent: Jun. 18, 2019

(54) SCREEN PRINTING APPARATUS WITH PIVOTING FRAMES

(71) Applicant: Infinite Numbering, LLC, Arlington, TX (US)

(72) Inventors: Jerardo Juarez, Arlington, TX (US); Ronnie Cruz, Arlington, TX (US); Rory H. Cruz, Burleson, TX (US)

(73) Assignee: Infinite Numbering, LLC, Arlington, TX (US)

( * ) Notice: Subject to any disclaimer, the term of this patent is extended or adjusted under 35 U.S.C. 154(b) by 0 days.

(21) Appl. No.: 16/047,388

(22) Filed: Jul. 27, 2018

Related U.S. Application Data

(63) Continuation of application No. 15/450,713, filed on Mar. 6, 2017, now Pat. No. 10,035,340.

(51) Int. Cl.

| | |
|---|---|
| ***B41F 15/08*** | (2006.01) |
| ***B41F 15/36*** | (2006.01) |
| ***B41F 27/00*** | (2006.01) |
| ***B41M 1/12*** | (2006.01) |
| ***B41C 1/14*** | (2006.01) |
| ***B41F 15/34*** | (2006.01) |
| ***B41F 15/00*** | (2006.01) |

(52) U.S. Cl.
CPC ..... *B41F 27/005* (2013.01); *B41C 1/14* (2013.01); *B41F 15/00* (2013.01); *B41F 15/08* (2013.01); *B41F 15/34* (2013.01); *B41M 1/12* (2013.01)

(58) Field of Classification Search
CPC ..... B41F 15/00; B41F 15/08; B41F 15/0813; B41F 15/0845; B41F 15/0863; B41F 15/34; B41F 15/36; B41F 27/005; B41F 15/16; B41C 1/14; B41M 1/12; B41L 13/06; B41L 13/02
USPC ..... 101/127, 127.1, 128.1
See application file for complete search history.

(56) References Cited

U.S. PATENT DOCUMENTS

| | | | | |
|---|---|---|---|---|
| 1,892,268 | A * | 12/1932 | Flockhart | B05C 17/08 101/127.1 |
| 4,229,890 | A * | 10/1980 | Dropinski | A47B 97/04 28/149 |
| 4,530,061 | A | 7/1985 | Henderson et al. | |
| 5,713,277 | A * | 2/1998 | Szarka | B41F 15/0818 101/123 |
| 5,987,789 | A * | 11/1999 | Lubina | A47B 97/04 38/102.1 |
| 6,938,227 | B2 | 8/2005 | Murphy et al. | |
| 8,390,648 | B2 | 3/2013 | Ptucha et al. | |
| 8,453,253 | B2 | 5/2013 | Strong et al. | |

(Continued)

FOREIGN PATENT DOCUMENTS

| | | | |
|---|---|---|---|
| WO | 1991015342 | A1 | 10/1991 |
| WO | 0184447 | A2 | 11/2001 |
| WO | 2010086578 | A1 | 8/2010 |

*Primary Examiner* — Leslie J Evanisko
(74) *Attorney, Agent, or Firm* — Mark D. Perdue

(57) ABSTRACT

A method of screen printing a design on a substrate, the method comprises the steps of controlling a computer-controlled plotter to cut an outline of the design into stencil material the stencil including a perimeter. Then, registering the perimeter of the cut stencil with marks on a printing screen and securing the cut stencil to the printing screen. Then, positioning the printing screen and cut stencil on the substrate and applying ink through the printing screen and stencil onto the substrate, wherein the design is reproduced on the substrate.

8 Claims, 5 Drawing Sheets

(56) References Cited

U.S. PATENT DOCUMENTS

| | | | |
|---|---|---|---|
| 8,776,686 | B2 | 7/2014 | Dubois |
| 8,838,482 | B2 | 9/2014 | Schindler et al. |
| 2004/0197548 | A1 | 10/2004 | Kopystecki |
| 2006/0207449 | A1 | 9/2006 | Lotspike et al. |
| 2008/0282914 | A1 | 11/2008 | Black et al. |
| 2008/0302258 | A1 | 12/2008 | Zhang et al. |
| 2009/0050003 | A1 | 2/2009 | Dubois |
| 2013/0036018 | A1 | 2/2013 | Dickerson |
| 2015/0339276 | A1 | 11/2015 | Bloem et al. |
| 2016/0032611 | A1 | 2/2016 | Santo |

* cited by examiner

SCREEN PRINTING APPARATUS WITH PIVOTING FRAMES

BACKGROUND OF THE INVENTION

1. Field of the Invention

The present invention relates broadly to the field of screen printing. More particularly, the present invention relates to screen printing of garments with designs and in particular to designs that vary from garment to garment, such as uniform numerals.

2. Summary of the Prior Art

Screen printing is a well-known technique for printing or applying designs or graphics to a substrate. It is a particularly common method for applying such designs to garments, namely t-shirts, jerseys, or other uniform shirts.

Screen printing is probably the most ubiquitous method of making economical uniform shirts or jerseys for athletic teams, especially at the lower, amateur levels of competition. Such uniforms are typically printed with a team name and logo or mascot and a number or numeral(s) identifying or associated with a certain player. A player name may also be applied.

Numerals, names, or other indicia that vary from jersey-to-jersey or shirt-to-shirt are the most problematic to screen print. For logos that do not change, a single screen can generally be set up to print an entire "run" of shirts or jerseys. However, numerals and player names will vary from item-to-item and require set up of special screens. Each screen then becomes effectively a single-use screen that must be "redone" for another shirt or jersey.

Commonly, die-cut (or other pre-made) stencils of letters or numerals are applied to the screens to spell a particular name or a particular number. Therefore, the printer must maintain an adequate inventory of preexisting letter or numeral stencils and the size and font of numbers and letters is limited to those "on hand" or available to the printer. Also, errors or variations in applying individual numerals or letters to the screens to make a name or number can be aesthetically unappealing and result in "scrap."

A need exists, therefore, for improvements in the screen printing process that avoid these problems.

SUMMARY OF THE INVENTION

It is a general object of the present invention to provide an improved screen printing process.

This and other objects of the present invention are achieved by a method of screen printing a design on a substrate comprising the steps of selecting a design from a database maintained in a computer and, using the computer, applying parameters to the design. The parameters may include a scaling factor. Again using the computer, the selected design and parameters are transmitted to a computer-controlled plotter/cutter, which cuts the selected design into stencil, the stencil including a perimeter. Next, a printing screen may be moved between a printing position and an alignment position and the perimeter of the cut stencil may be aligned with marks on the printing screen and secured to the printing screen. The printing screen then may be moved from the alignment position to a printing position. The printing screen and cut stencil are applied to a substrate and ink is applied through the printing screen and stencil onto the substrate, wherein the design is reproduced on the substrate.

Other objects, features, and advantages of the present invention will become apparent with reference to the drawings and to the detailed description of the invention, which follows.

DETAILED DESCRIPTION

Figure 1:
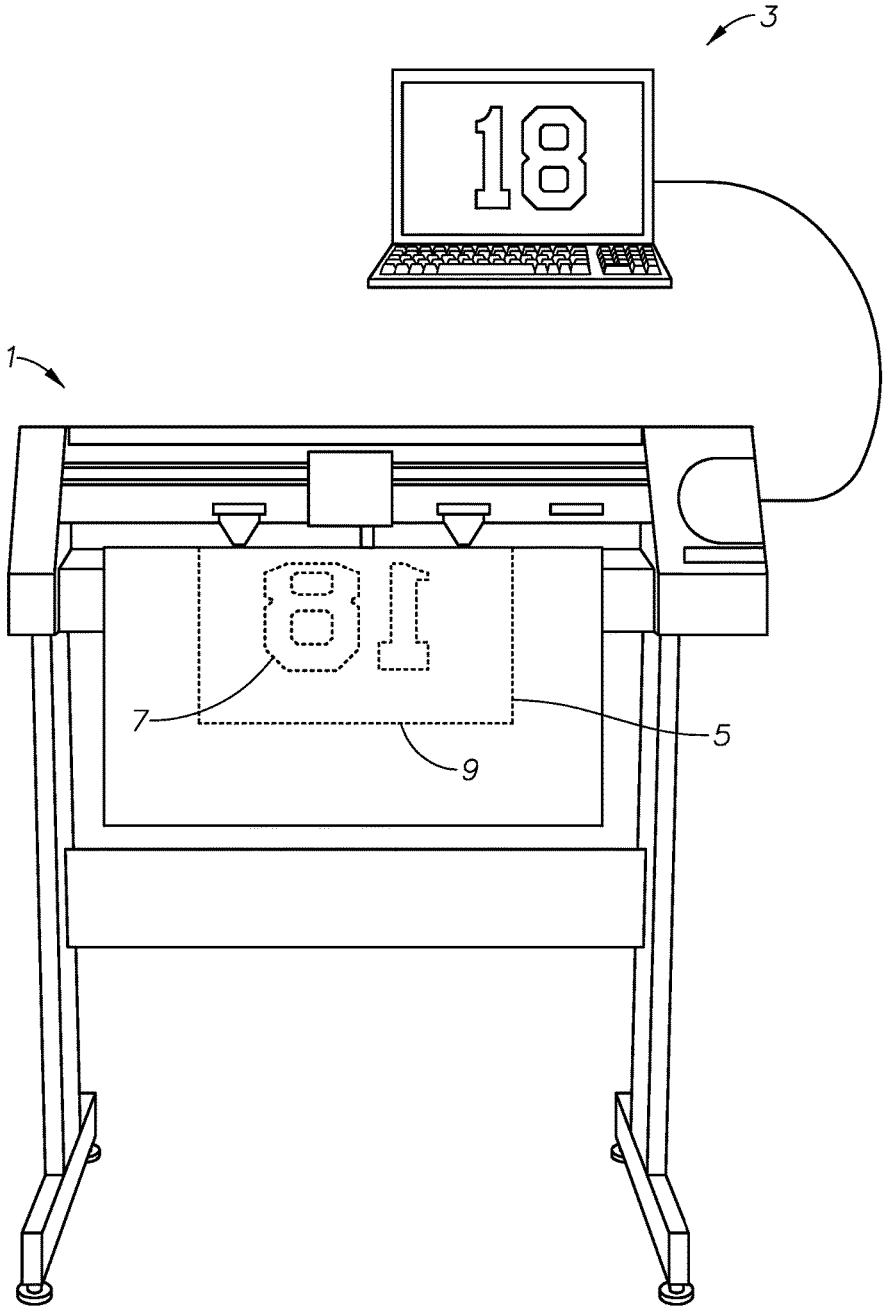
FIG. 1 depicts a computer-controlled plotter/cutter of the type contemplated by an embodiment of the present invention.

Turning now to the Figures, and particularly to FIG. 1, a computer-controlled cutter or plotter 1 is illustrated connected to a personal computer (PC) 3. Computer-controlled cutter or plotter may be a commercially available unit that is controlled by a computer, in much the same way as a conventional printer or graphic plotter, to cut (instead of print) a design into a substrate material. Typically, such cutters are used to cut designs in adhesive-backed vinyl for decals, signage, graphics and the like. In this embodiment of the present invention, plotter/cutter is used to cut a design (actually the "negative" of a design) into a stencil material for use in screen printing the design onto a substrate. An exemplary plotter is the Vinyl Express EnduraCut 2 24" Friction Feed Cutting Plotter, available from SIGNWarehouse, 2614 Texoma Drive, Denison, Tex. 75020.

Computer 3 may be a conventional personal computer, of the desktop or laptop variety; a dedicated, purpose-built computer; a tablet, or even a smartphone. Computer must be capable of storing and/or accessing and manipulating designs to be cut by plotter 1 and communicating the design to and controlling plotter 1 to actually cut the design. Computer 3 and plotter 1 may be connected for communication and control by parallel printer interface, RS-232 interface, IEEE 488, Universal Serial Bus (USB), or other means that permits communication of the selected design to plotter 1 in executable instructions to control the cutting of the design into the stencil medium.

Designs may be created originally and stored on computer 3, or one or more predetermined, preexisting designs maintained in storage on computer 3. The designs may reside simply in file storage (folders or directories, by filename); or in a searchable, formal database maintained in file storage of computer 3 or a local network; or even in a remotely accessible collection of designs maintained "in the cloud." For purposes of this application, any collection of one or more designs maintained in any storage medium accessible by computer 3 may be considered a "database" or "database of designs."

Figure 2:
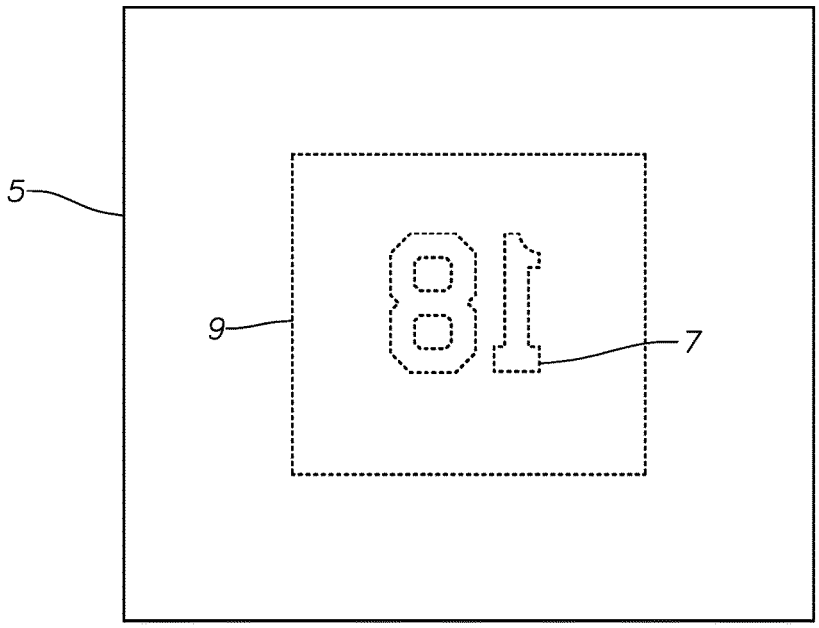
FIG. 2 illustrates a stencil cut according to the method of the present invention.

According to one embodiment of the method of the present invention, a user selects a design ultimately to be screen printed on a substrate in computer 3. As previously mentioned, the design may be selected from a database of designs or generated by the user (the term "select" a design, as used herein, includes both choosing, or choosing and modifying, an existing design; and generating an original or new design). As illustrated in FIGS. 1 and 2, the selected design stencil 7 is a numeral (18). The user may apply or vary parameters of the design, most typically its size or proportion, i.e. scaling. Other parameters may include the color(s) to be screen printed, which may determine whether a fill, outline, underbase, or spaced stencil is required (all conventional screen printing techniques). Typically, the size or scaling parameter of the design will be modified or selected to fit on the substrate in a desired location. For example, if a numeral is to be printed on the back of a t-shirt or jersey, its size will be selected to occupy the majority of the back of the garment of a given size. The design may also be a combination of two designs, as in the case of a two-digit numeral, the first and second digits may be combined and an appropriate scaling parameter may be applied to each of the digits to make them "match." A name may be spelled out from an existing font or set of letters so that a single stencil can be used, rather than a separate stencil for each letter. Names and numerals may be combined into a single stencil, thereby avoiding multiple stencils and multiple printing operations.

This manipulation of the parameters of the design may occur in a commercially available graphics program such as Corel® Draw®, available from Corel Corporation, or another similar program, or in dedicated software. Such software may also include interfaces with the plotter drivers to control plotter 1.

After selecting the design and applying the desired and appropriate parameters, the user may execute the commands to communicate or send the design to plotter 1, for cutting. The design (or a "negative" outline thereof) then is cut by plotter 1 into the stencil medium 5. Stencil medium 5 may be an adhesive-backed paper or polymer sheet that is flexible and capable of being fed through and cut by plotter 1 and is also sufficiently ink-impervious to perform properly as a stencil for screen printing. Alternatively, adhesive may be applied to stencil material after cutting or omitted entirely. A preferred and exemplary stencil medium is Matte PVC 3-Mil UV, which is an adhesive-backed PVC sheet available as part number PSLM-61150 from AMCAD and Graphics LP, 1201 Tappan Circle, Carrollton, Tex. 75006.

As part of cutting the stencil 7, a stencil perimeter 9 of selected size or dimension is defined and cut into stencil medium 5. Perimeter 9 aids in proper positioning or registry of stencil 7 on the printing screen, as described below in connection with FIG. 4. Stencil 7 may be separated from the remainder of stencil medium 5 along perimeter cut line for ease of handling. The other "cut" portions of stencil 7 may be left intact until the stencil is applied to the screen, or may be removed or separated prior to application.

Figure 3:
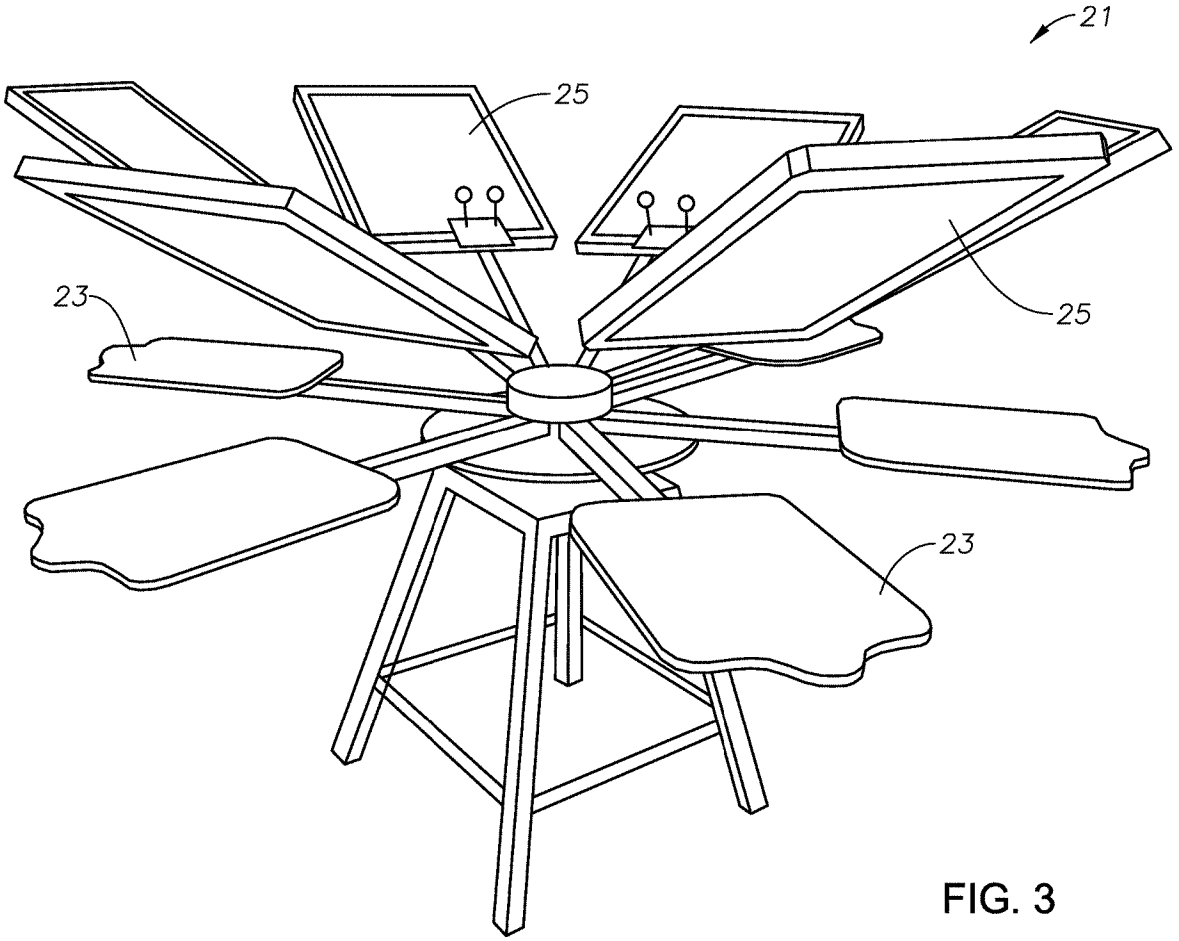
FIG. 3 depicts a screen-printing apparatus of the type contemplated by an embodiment of the present invention.

FIG. 3 is a depiction of a generally conventional screen-printing carousel 21 of the type that can be used in the method of the present invention. Carousel 21 includes multiple platens 23, upon which substrates are positioned for printing. Above each platen is disposed a screen holder 25, which positions a screen above each platen 23 and permits the screen to be engaged (pressed down) with a substrate positioned on each platen 23. Carousel 21 provides multiple printing stations (platen 23 and screen holder 25) and permits each station to be rotated about a central axis for access to each station. Other single- and multiple-station screen printing apparatus of various configurations exist that employ a platen and a screen holder and are thus useful in the method according to the present invention.

Figure 4:
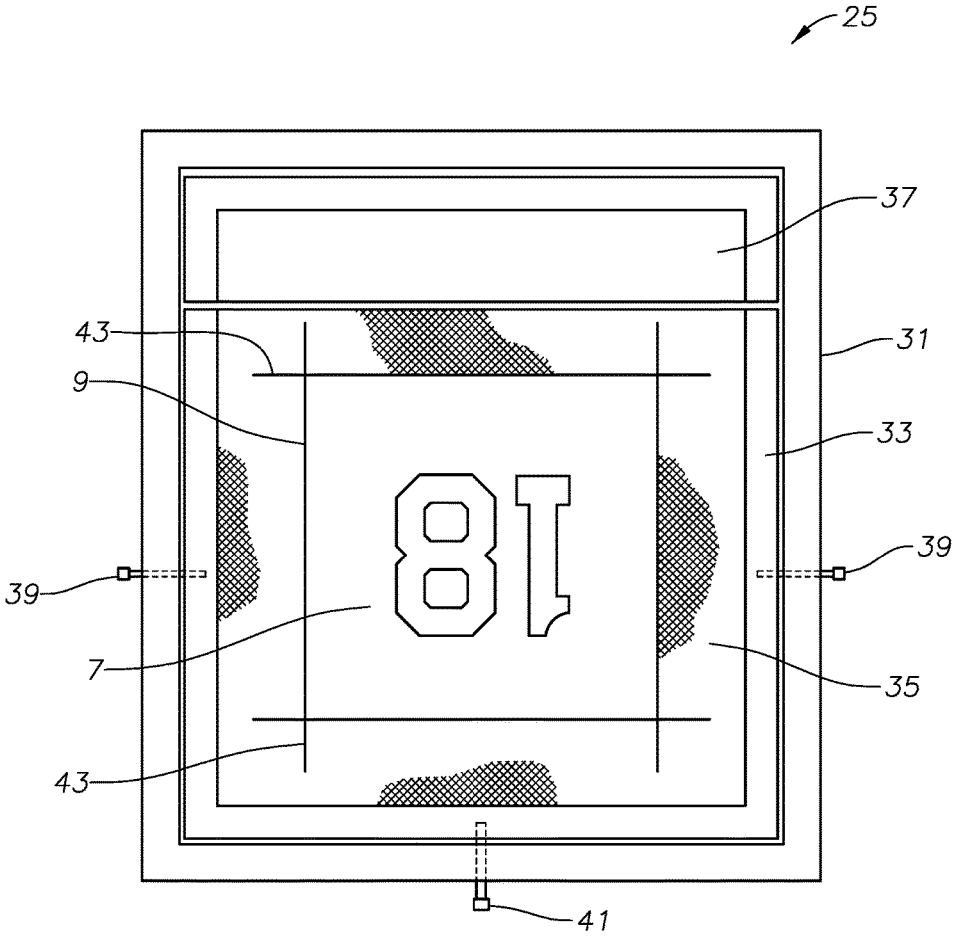
FIG. 4 is a top plan view of a screen of the type contemplated by an embodiment of the present invention.
Figure 5:
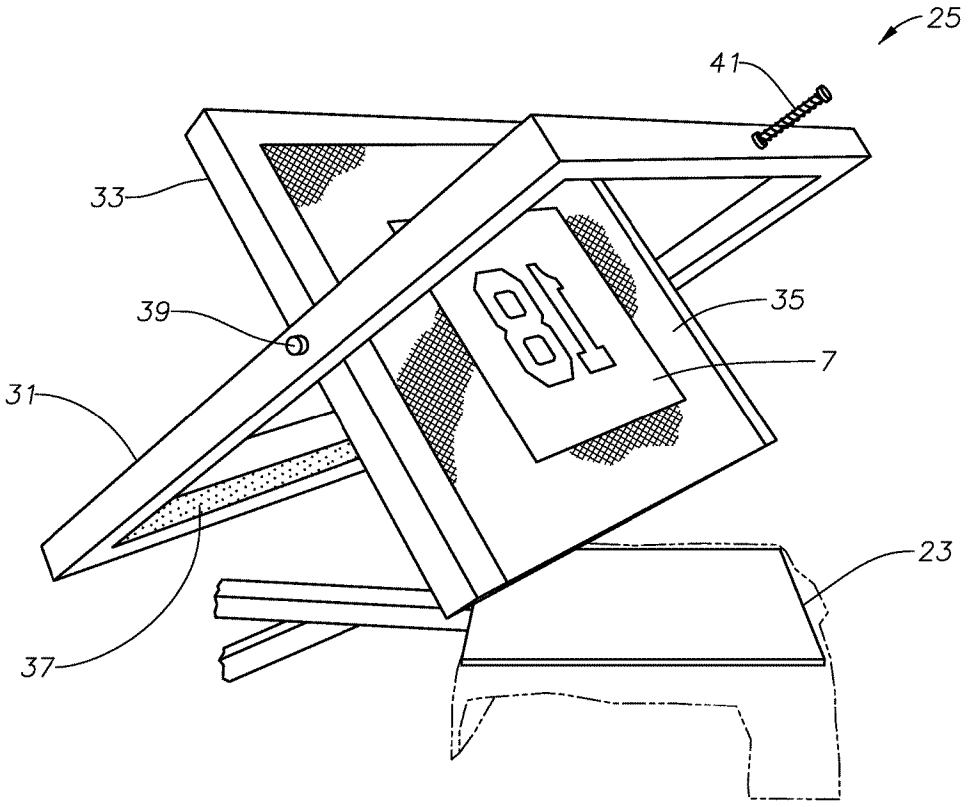
FIG. 5 illustrates a portion of the apparatus of FIG. 3, incorporating the screen of FIG. 4, shown in an alignment position.

FIGS. 4 and 5 depict a screen holder 25 particularly adapted for use in the method of the present invention. Screen holder 25 comprises an outer, rectangular frame 31, configured for attachment to carousel 21 or other screen printing press, and an inner, rectangular frame 33 disposed within outer frame 31. Inner frame 33 contains a mesh screen 35 for printing. An ink reservoir 37 may be optionally provided adjacent inner frame 35 as a space for ink to be dispensed and applied to the fill blade or "squeegee" prior to application to screen 35 for actual printing.

Inner frame 33 contains the mesh screen 35 for printing and is pivotally mounted in outer frame 31 by a pair of pivots 39. Inner frame 33 thus is rotatable or pivotable relative to and within outer frame 31, permitting the lower or printing side of screen 35 to face upward (an alignment position as shown in FIG. 5) for ease in applying stencil 7 to screen 35. A movable stop pin 41 is provided on one end of outer frame 31 and engages inner frame 33 to secure inner frame in a downwardly facing printing position. Registry or alignment marks 43 are printed or otherwise formed on screen 35 and correspond with perimeter 9 of stencil 7 to assist in proper positioning of stencil 7 on screen 35. Marks 43 may take the form of "cross-hairs" or "L-shaped" lines made on screen 35 for registry with corners of a stencil, or may be a full outline of perimeter 9 of stencil 7.

After stencil 9 is cut, as described above, inner frame 33 of screen holder 25 is rotated to the alignment or upward position (alignment position can be rotated 180 degrees from printing position, or anything between 0 and 180 degrees, as the user prefers), adhesive backing is removed from the stencil medium (or adhesive applied), and periphery 9 of stencil 7 is aligned with registry or alignment marks 43 and secured or adhered to screen 35. Cut portions of the stencil through which ink is to be applied or screened are removed from stencil 7. Inner frame 33 then is rotated to the printing position and secured there with stop pin 41.

A garment or other substrate may be positioned on platen 23 for printing (shown in dashed lines in FIG. 5). Screen holder 25 and screen 35 then are pressed downward and engaged with the garment on platen 23. Ink is applied to screen 35 and "squeegeed" or otherwise pressed through screen and onto the garment to screen print or reproduce the design as is conventional. Stencil 7 renders the mesh screen 35 impermeable to ink and the design is transferred to the substrate.

The method and apparatus according to the present invention possess a number of advantages. Primarily, it increases the flexibility and efficiency of a relatively small screen printing operation that is dependent on manual screen presses and stencils for them. It gives such operations the ability to create large numbers of similar or identical stencils and to vary them according to need without complete reliance on third-party suppliers or expensive and complex photo-emulsion stencils and equipment.

The invention has been disclosed with reference to preferred and exemplary embodiments thereof. It is thus not limited, but is susceptible to variation and modification without departing from the scope and spirit of the invention.

The invention claimed is:

1. A screen-printing apparatus comprising:

a platen upon which a substrate is disposed for screen printing;

an outer frame disposed above the platen, wherein relative movement between the platen and outer frame brings them into contact;

an inner frame mounted for rotation within the outer frame, the inner frame carrying a screen, wherein the inner frame and screen are rotatable between a first position in which the screen is disposed for printing and a second position in which the screen is disposed for application of a stencil, wherein the inner and outer frames are generally rectangular and include a pair of opposing side members and top and bottom members;

a pair of pivot pins, each of the pivot pins extending between the side members of the inner and outer frames, wherein the inner frame pivots about the pivot pins and rotates relative to the outer frame; and a removable stop pin extending between the top members of the inner and outer frames to secure the inner and outer frames against rotation therebetween.

2. The screen-printing apparatus of claim 1, wherein the first and second positions of the inner frame and screen are 180 degrees apart.

3. The screen-printing apparatus of claim 1, wherein the platen is stationary and the outer and inner frames are movable relative to the platen.

4. A screen-printing apparatus comprising:

a platen upon which a substrate is disposed for screen printing;

an outer frame disposed above the platen and movable into and out of contact with the platen, the outer frame being generally rectangular and including a pair of opposing side members and top and bottom members;

an inner frame rotatably mounted by a pair of pins within the outer frame, the inner frame carrying a screen, wherein the inner frame and screen are rotatable between a first position in which the screen is disposed for printing and a second position in which the screen is disposed for application of a stencil, the inner frame being generally rectangular and including a pair of opposing side members and top and bottom members; and a stop pin between the top members of the inner and outer frames, the stop pin operable to secure the inner frame in at least one of the first and second positions and to secure the inner and outer frames against rotation therebetween.

5. A screen-printing apparatus comprising:

a platen upon which a substrate is disposed for screen printing;

a print screen assembly disposed above the platen, wherein relative movement between the platen and print screen assembly brings them into contact, the print screen assembly including:

an outer frame;

an inner frame mounted for rotation within the outer frame, the inner frame carrying a screen, the inner and outer frames being generally rectangular and including a pair of opposing side members and a pair of end members joining the side members;

a pair of pivot pins, each of the pivot pins extending between the side members of the inner and outer frames, wherein the inner frame pivots about the pivot pins and rotates relative to the outer frame between a first position in which the screen is disposed for printing and a second position in which the screen is disposed for application of a stencil; and a removable stop pin extending between the end members of the inner and outer frames to secure the inner and outer frames against rotation therebetween.

6. The screen-printing apparatus of claim 5, wherein the first and second positions of the inner frame and screen are 180 degrees apart.

7. The screen-printing apparatus of claim 5, wherein the platen is stationary and the print screen assembly is movable relative to the platen.

8. The screen-printing apparatus of claim 7, further comprising:

a plurality of platens arranged in a circular configuration;

a screen assembly disposed above each platen.

* * * * *